United States Patent [19]

Schramayr

[11] Patent Number: 4,602,580

[45] Date of Patent: Jul. 29, 1986

[54] METHOD AND APPARATUS FOR FORMING SLEEVE PLACKETS

[75] Inventor: Ernst Schramayr, Oneida, N.Y.

[73] Assignee: Cluett Peabody & Co., Inc., New York, N.Y.

[21] Appl. No.: 693,400

[22] Filed: Jan. 22, 1985

[51] Int. Cl.[4] ..... D05B 97/00; D05B 3/12; D05B 21/00

[52] U.S. Cl. ..... 112/262.3; 112/104; 112/121.12; 112/121.26; 112/121.27; 112/265.1; 223/38

[58] Field of Search ..... 112/262.3, 262.2, 262.1, 112/104, 113, 114, 121.15, 121.12, 121.26, 121.27, 265.1; 223/38

[56] References Cited

U.S. PATENT DOCUMENTS

| | | | |
|---|---|---|---|
| 2,453,623 | 11/1948 | Gilbert et al. | 223/38 |
| 3,507,234 | 4/1970 | Bryan | 112/121.27 |
| 3,664,283 | 5/1972 | McFalls | 112/121.15 |
| 3,980,033 | 9/1976 | Frost et al. | 112/121.27 |
| 4,160,423 | 7/1979 | Scholl et al. | 112/121.12 |
| 4,389,957 | 6/1983 | Block et al. | 112/104 X |

*Primary Examiner*—H. Hampton Hunter

*Attorney, Agent, or Firm*—Cluett Peabody & Co., Inc.

[57] ABSTRACT

There is disclosed a method and apparatus of forming sleeve plackets which utilizes blades insertable into and retractable from placket halves and which includes means for stretching the placket halves about the blades and means for sequentially retracting the blades for final stitching and completing the placket.

4 Claims, 28 Drawing Figures

METHOD AND APPARATUS FOR FORMING SLEEVE PLACKETS

BACKGROUND OF THE INVENTION

The present invention is directed to improvements in the finishing and reinforcement of slit openings in garments, for example in the sleeves of shirts or blouses. Such openings in better quality garments are commonly finally formed in a placket which reinforces the areas adjacent to the slit, thus protecting the opening from tearing and providing decorative trim with respect to the sides and closed end of the opening. Apparatus for forming such plackets or slit facings has been illustrated and described in U.S. Pat. Nos. 2,453,623, 3,664,283 and 4,160,423.

The common purpose of the teachings in these patents and others is to automate as much as possible or feasible a series of intricate folding and stitching steps which if performed entirely manually reduce uniformity, quality and output in the production of garments.

The present invention provides improved apparatus for accomplishing the stated objective.

SUMMARY OF THE INVENTION

The method of the present invention provides steps to form a finished placket with respect to a slitted opening in a piece of fabric (which may be a sleeve opening) comprising first forming an open-ended tubular member and placing said member perpendicular and immediately adjacent to the closed end of the slit. Thereafter, the respective sides of the opening are folded toward and into the tube and each side is attached as by stitching to the slit facing part of the tube which forms in effect two tube sections or placket halves. The placket halves are then folded to be superimposed. Thereafter, blades are inserted within each placket halve and an intermediate blade is inserted between the placket halves themselves. The placket halves are caused to be stretched over the respective blades and the intermediate blade is extended to straighten and flatten the area at the closed end of the slitted opening between each placket halve. The final step of the method incorporates the use of a clamp/template in conjunction with a sewing machine head to stitch the respective superimposed placket halves to each other at the closed end of the placket.

The apparatus of the present invention provides means for actuating the aforementioned blades in the manner required and provides a means (stretch pin) to stretch the placket halves over the blades. Also provided is a blade carrier assembly which is movable linearly and is rotatable to effect loading of the blades and then carrying of the fabric and placket into a sewing machine head.

DESCRIPTION OF A PREFERRED EMBODIMENT

Figures 5, 6A, 6B, 6C, 6D:
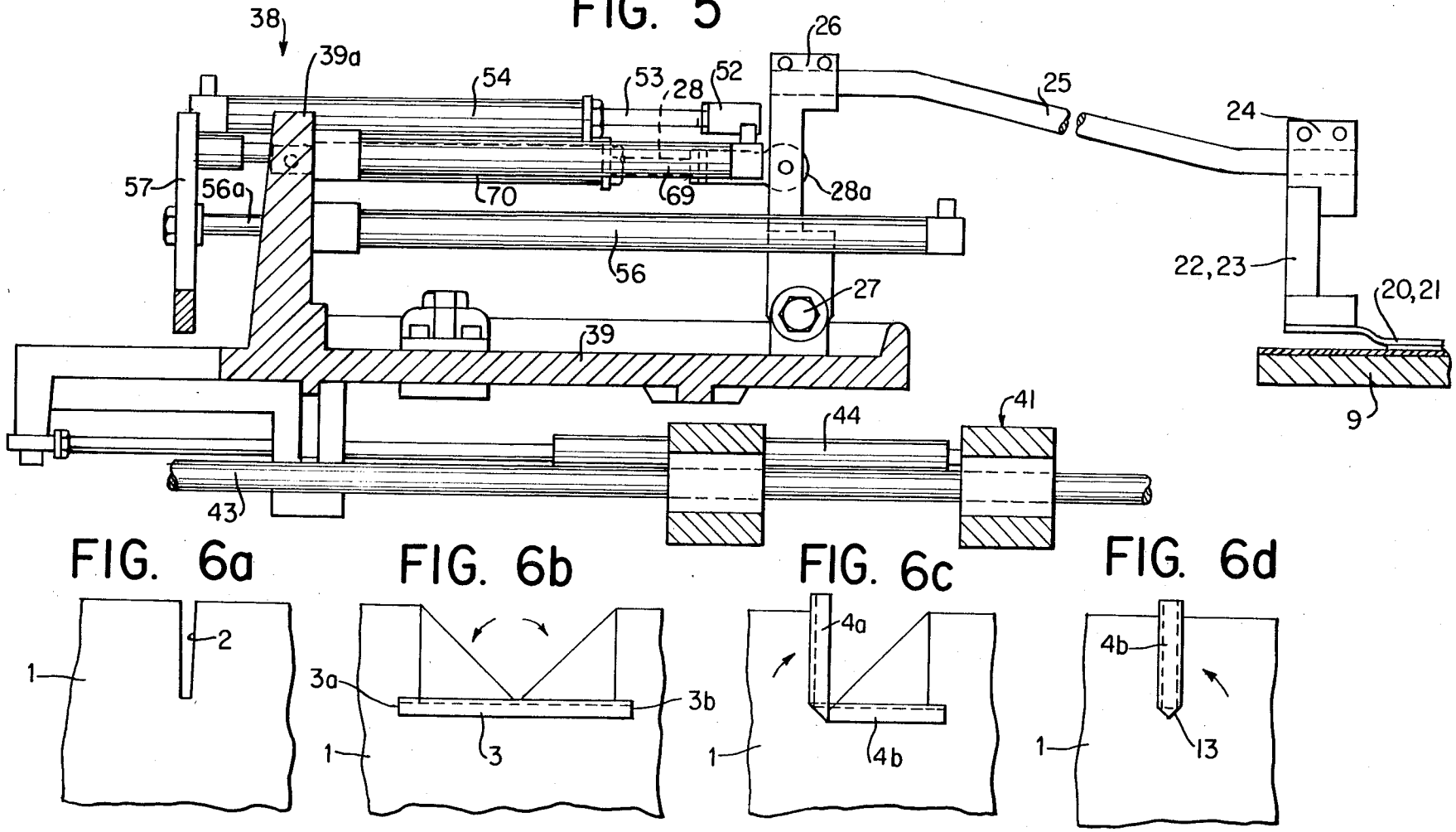
FIG. 5 is a view taken in the direction of arrows V—V of FIG. 4.
FIGS. 6*a*-6*d* are schematic illustrations showing the placket folding and stitching procedure preliminary to use of the apparatus of the invention.

In order to best understand the present invention, the method thereof shall be initially described in conjunction with certain portions of the apparatus, and then the apparatus shall be more fully described. Moreover, although the example chosen in the description is the formation of a sleeve placket, it should be understood that the invention has broad application generally to the formation of plackets respecting slitted openings and should not be restricted to sleeve plackets per se. Accordingly, reference is made initially to FIGS. 6*a*-6*d* and to FIGS. 11-25. A sleeve blank 1 shown in FIG. 6*a* contains a generally rectangular slit 2. FIG. 6*b* shows the addition of a tubular member 3 which is placed immediately adjacent to the closed end of the slit 2 to form a tube having open ends 3*a*, 3*b*. Thereafter, the sides of the slit are folded in the direction indicated and are received and stitched within member 3. FIGS. 6*c* and 6*d* illustrate the repositioning of the respective portions 4*a* and 4*b* of member 3 (placket halves). Portion 4*b* is superimposed upon 4*a*, and the open ends of the respecting placket halves face outwardly of the sleeve blank 1 and in alignment with opening 2.

Figure 11:
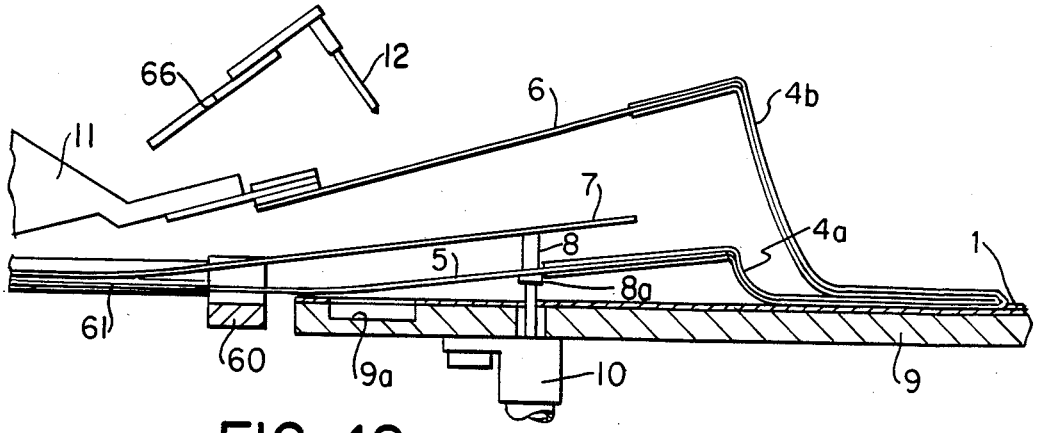
FIG. 11 is a view similar to FIG. 9 with placket halves partially loaded upon the folder blades.
Figure 12:
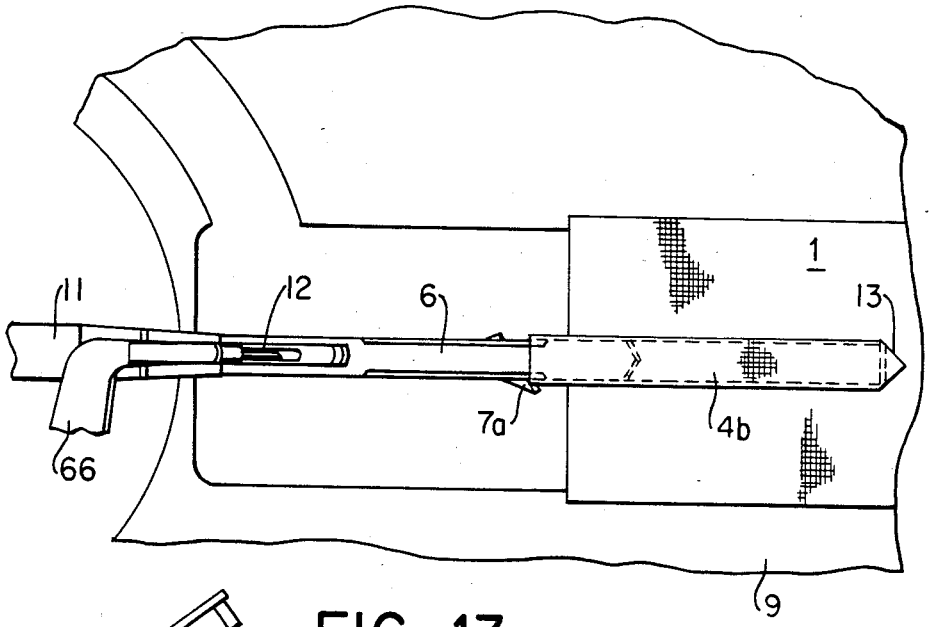
FIG. 12 is a plan view of FIG. 11.
Figure 13:
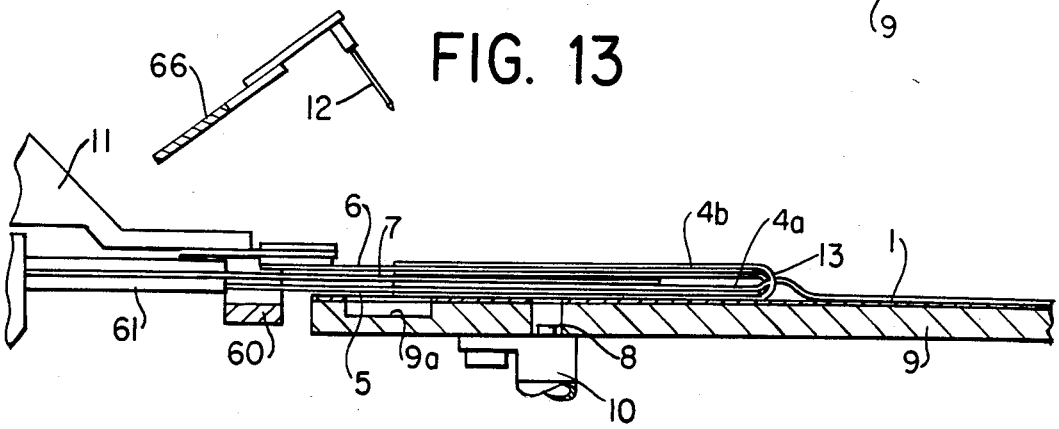
FIG. 13 illustrates the position of the placket and folder blades with the folder blades in their horizontal position.
Figure 14:
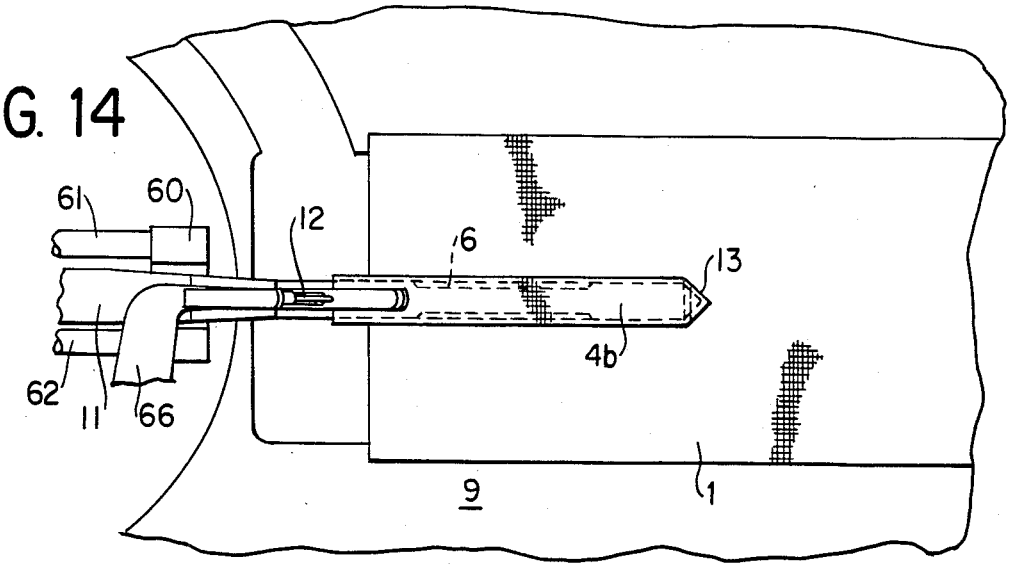
FIG. 14 is a plan view of FIG. 13.

Referring now to FIGS. 11 and 12, there are shown portions of the apparatus of the invention together with the sleeve blank 1 and placket halves 4*a*, 4*b*. Lower and upper folder blades 5 and 6 are shown having been partially inserted by an operator into placket halves 4*a* and 4*b* respectively. Blades 5 and 6 and center blade 7 are aligned (see FIG. 12). In their work receiving positions, blades 5, 6 and 7 are separated vertically to receive the placket halves 4*a*, 4*b*, and blade 6 has been rotated upwardly. Pin 8 is thrust upwardly through table 9 by actuator 10. By this means, the end of pin 8 engages the lower surface of blade 7 and collar 8*a*, the lower surface of blade 5 to spread the blades as shown for loading. It will be noted that pin 8 when extended prevents placket halve 4*a* from being drawn over blade 5 beyond the pin. In FIG. 13 (plan view FIG. 14), pin 8 has been retracted and the resilience of blades 5 and 7 causes them to lie one above the other, center blade 7 functioning to support blades 5 and 6 in spaced relation as shown. The support 11 for blade 6 has been rotated to lower blade 6 into its horizontal position above blades 5 and 7. Placket halves 4*a*, 4*b* are manually advanced by the operator over blades 5 and 6 to the position of FIG. 13.

Figure 15:
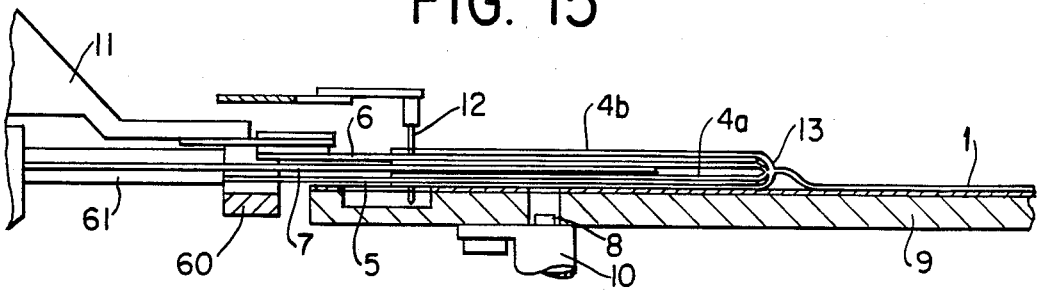
FIG. 15 illustrates the means for holding the ends of the placket halves prior to extension of the center blade between the placket halves.
Figure 16:
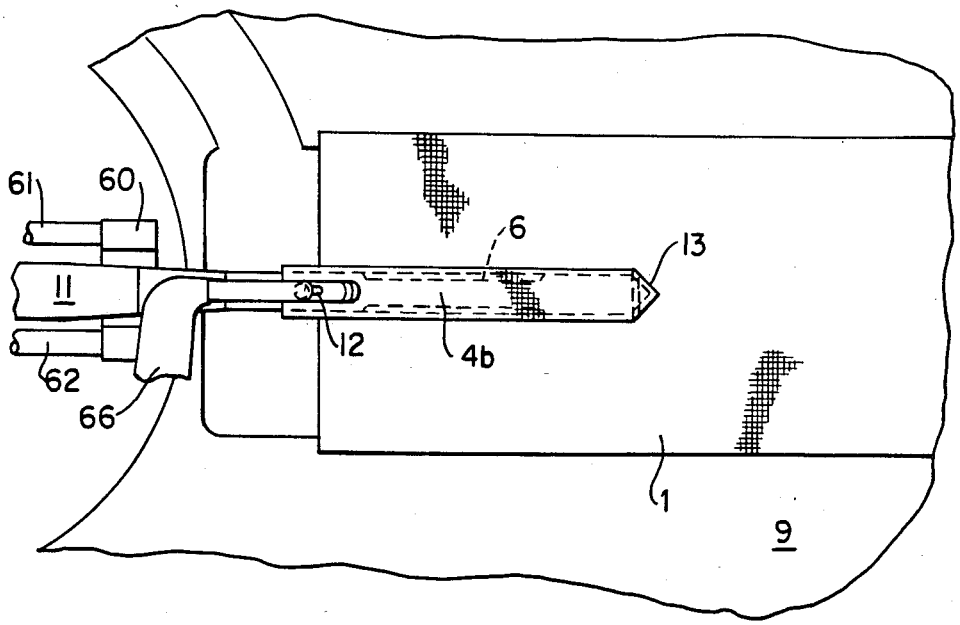
FIG. 16 is a plan view of FIG. 15.
Figure 17:
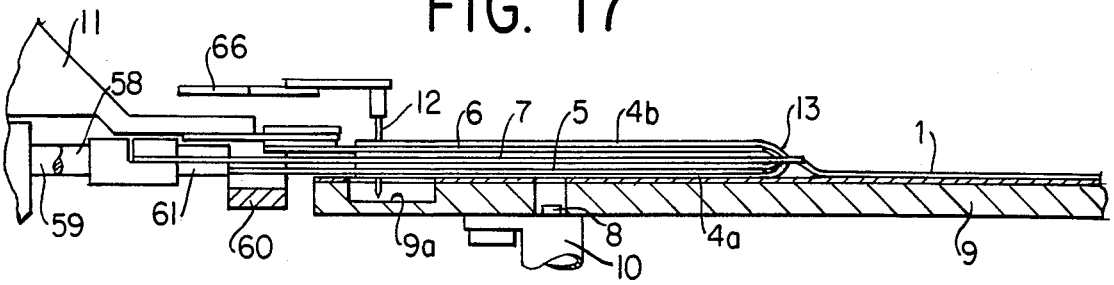
FIG. 17 illustrates the extension of the center blade between placket halves.
Figure 18:
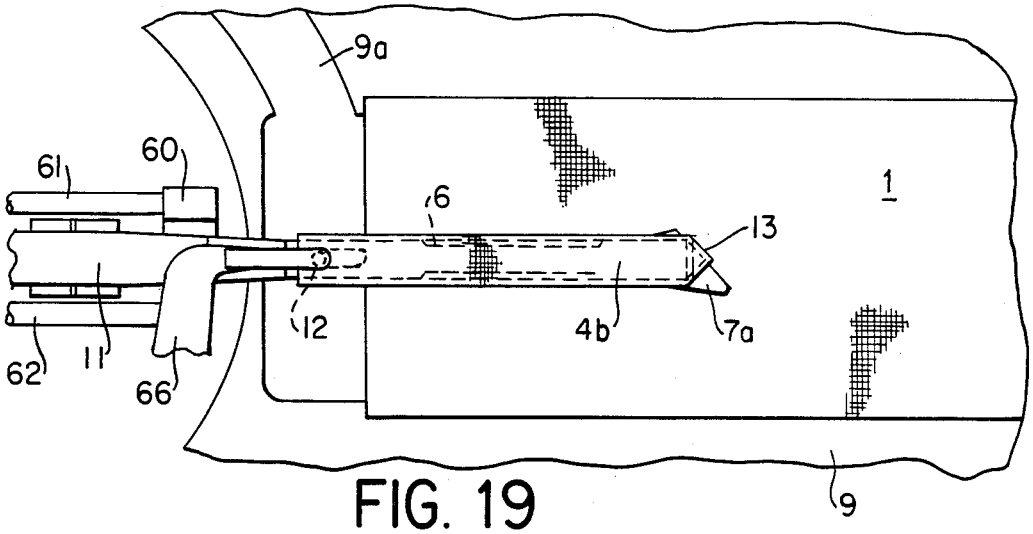
FIG. 18 is a plan view of FIG. 17.
Figure 19:
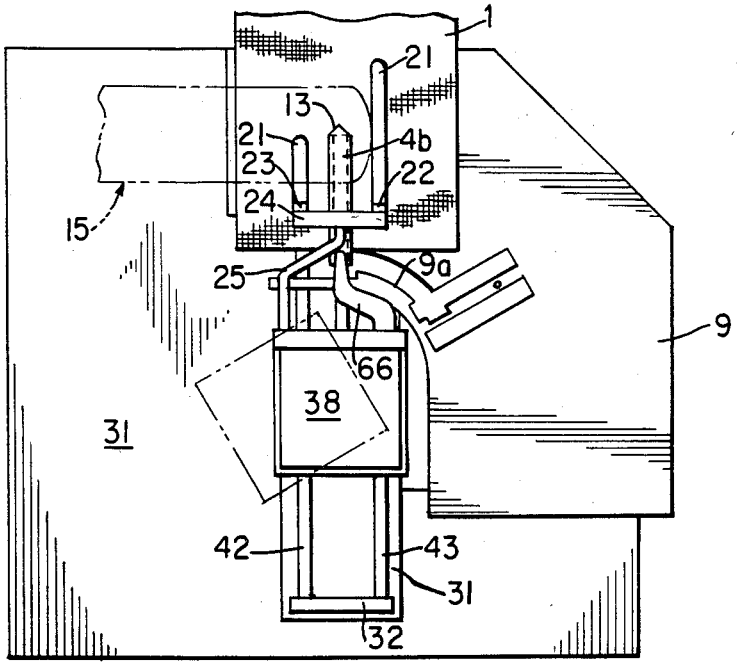
FIG. 19 shows the carrier pivoted to bring the placket to the sewing head.

In FIGS. 15 and 16, a pin 12 (hereinafter sometimes referred to as a stretch pin) is caused to descend and to pierce the ends of placket halves 4*a*, 4*b*. Note recess 9*a* in table 9 to accommodate this action. In FIGS. 17 and 18, the stretch pin 12 is retracted to draw placket halves 4*a* and 4*b* to fullest extension over blades 5 and 6. Blade 7 is then fully extended between the placket halves 4*a*, 4*b*. The end 7*a* of blade 7 is oversized and conforms to one side of the triangular connection 13 between the plackets 4*a* and 4*b* and sleeve 1. Thus, section 7*a* when blade 7 is fully extended will straighten the triangular connecting parts between 4*a* and 4*b* and sleeve 1 to assure proper orientation of these connecting parts and sleeve 1 prior to final stitching.

Figure 20:
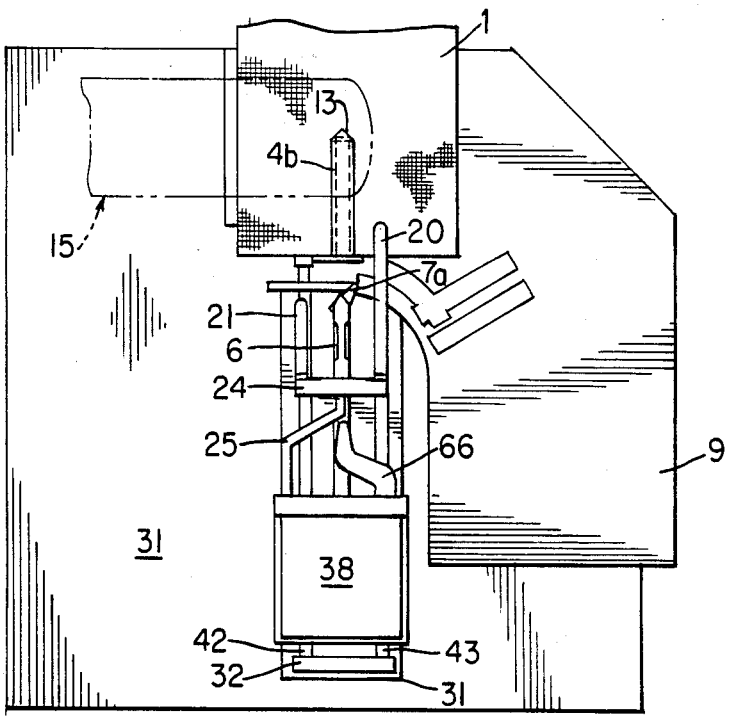
FIG. 20 illustrates the position prior to sewing wherein the folder blades have been retracted.
Figure 21:
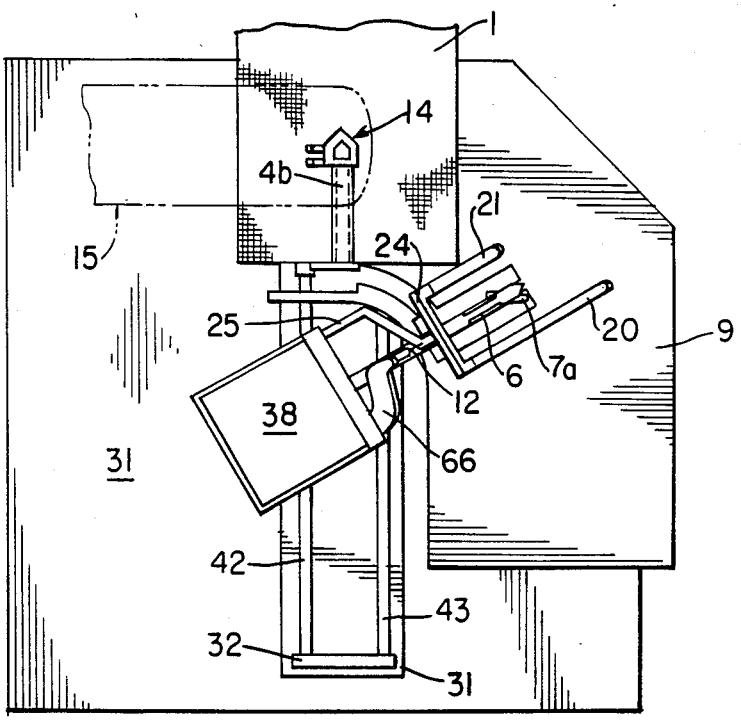
FIG. 21 illustrates the positioning of the sewing clamp/template to permit sewing of the placket and with carrier assembly returned to loading position.
Figure 22:
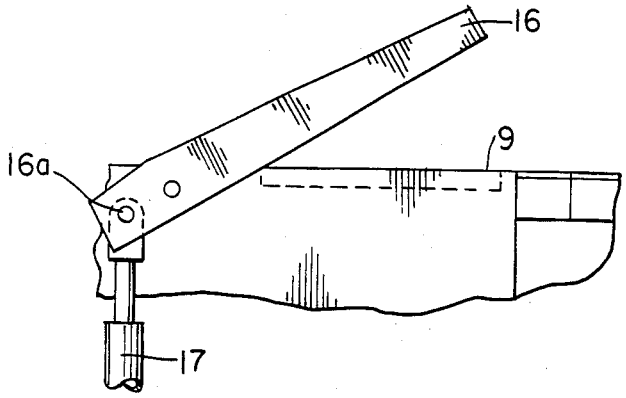
FIG. 22 is a view taken in the direction of arrows (XXII—XXII) of FIG. 1.
Figure 23A:
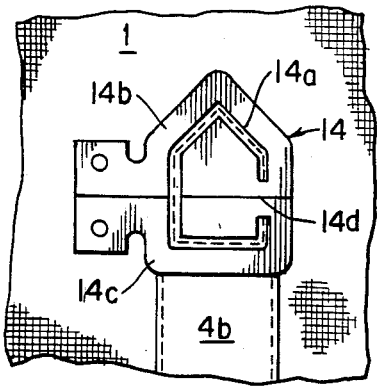
FIG. 23 is an enlarged detailed showing of the sewing clamp/template.
Figure 23B:
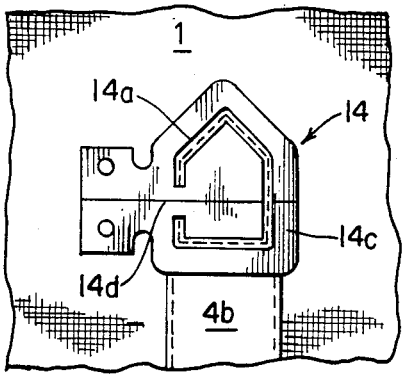
Figure 24:
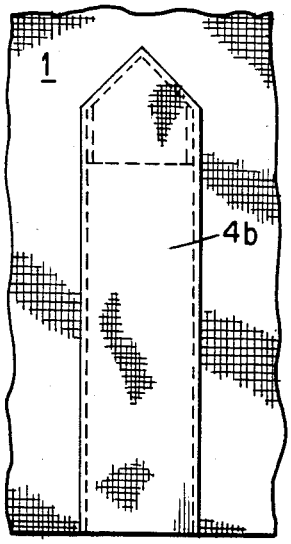
FIG. 24 is a plan view of the completed placket.
Figure 25:
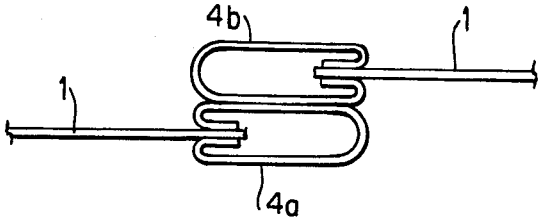
FIG. 25 is an end view of the placket of FIG. 24.

Fabric hold-down fingers 20, 21 (FIGS. 19–21) secure the work piece and maintain the relationship just described as the entire carrier assembly including blades 5, 6, 7 and stretch pin 12 is rotated into operative relation with respect to the sewing head 15. FIG. 20 illustrates withdrawal of blades 5, 6 and 7 and retraction of pin 12. The work piece is clamped by means of clamp-/template 14 which is in effect a foot of the sewing head 15. After the carrier assembly 38 is returned to the loading position of FIG. 11 (as shown in FIG. 21), sewing clamp/template 14 guides the final stitching of inner superimposed ends of placket halves 4*a*, 4*b* to form finished placket shown in FIG. 24. The clamp-/template detail is shown in FIG. 23 and illustrates clamp/template 14 which defines stitch path 14*a*. Portion 14*b* is contiguous with outer part 14*c* by connection therewith at 14*d*. Before final stitching takes place, the outer ends of placket halves 4*a*, 4*b* are trimmed by knife 16 (FIG. 22) connected to actuator 17 and pivotally mounted at 16*a*.

Having described the method of the invention, we shall now proceed with a detailed description of the apparatus, more specifically the apparatus provided to control, move and manipulate the operative components which have been described in the performance of the method.

Figure 1:
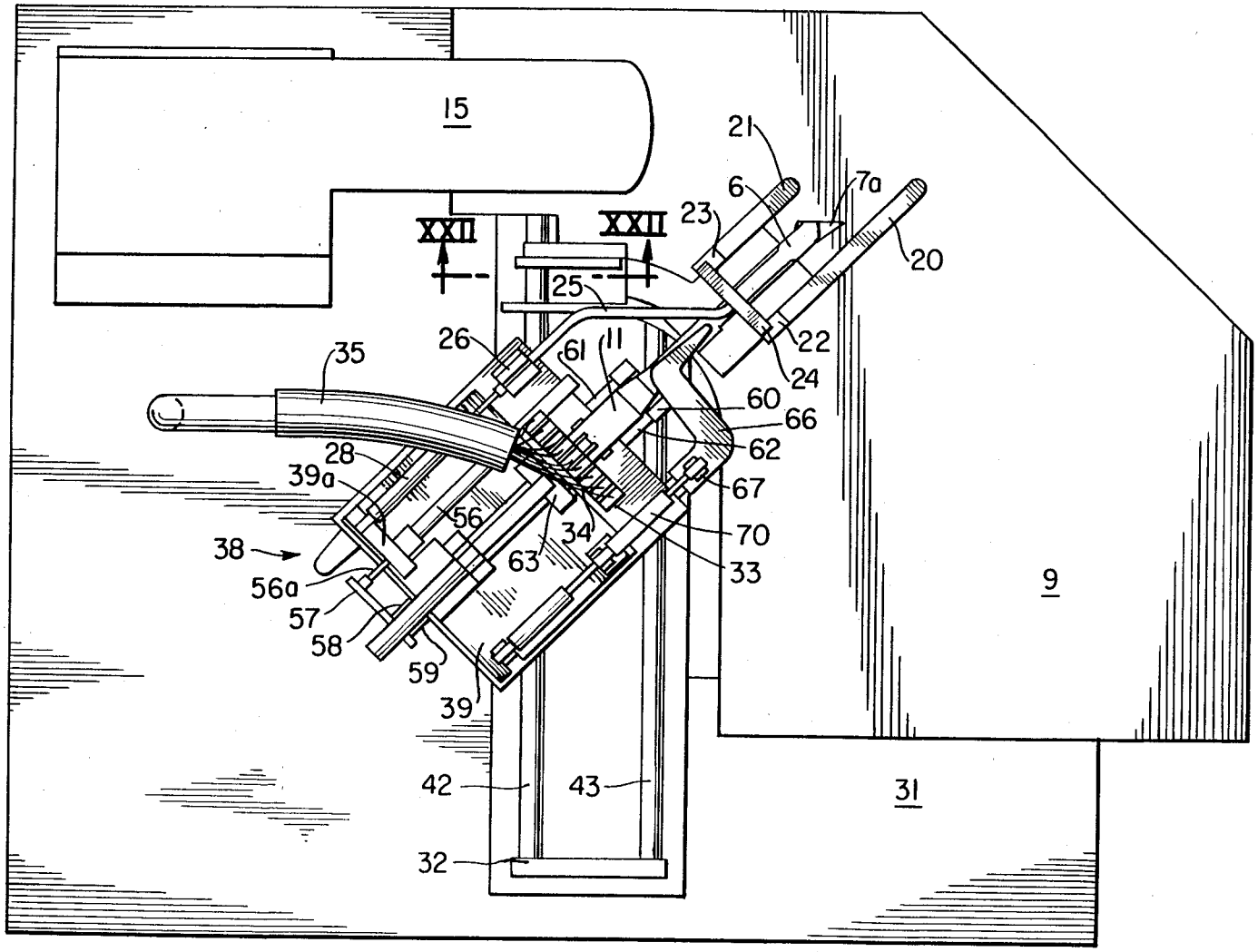
FIGS. 1 and 2 are respectively plan and elevation views of the apparatus of the present invention.
Figure 2:
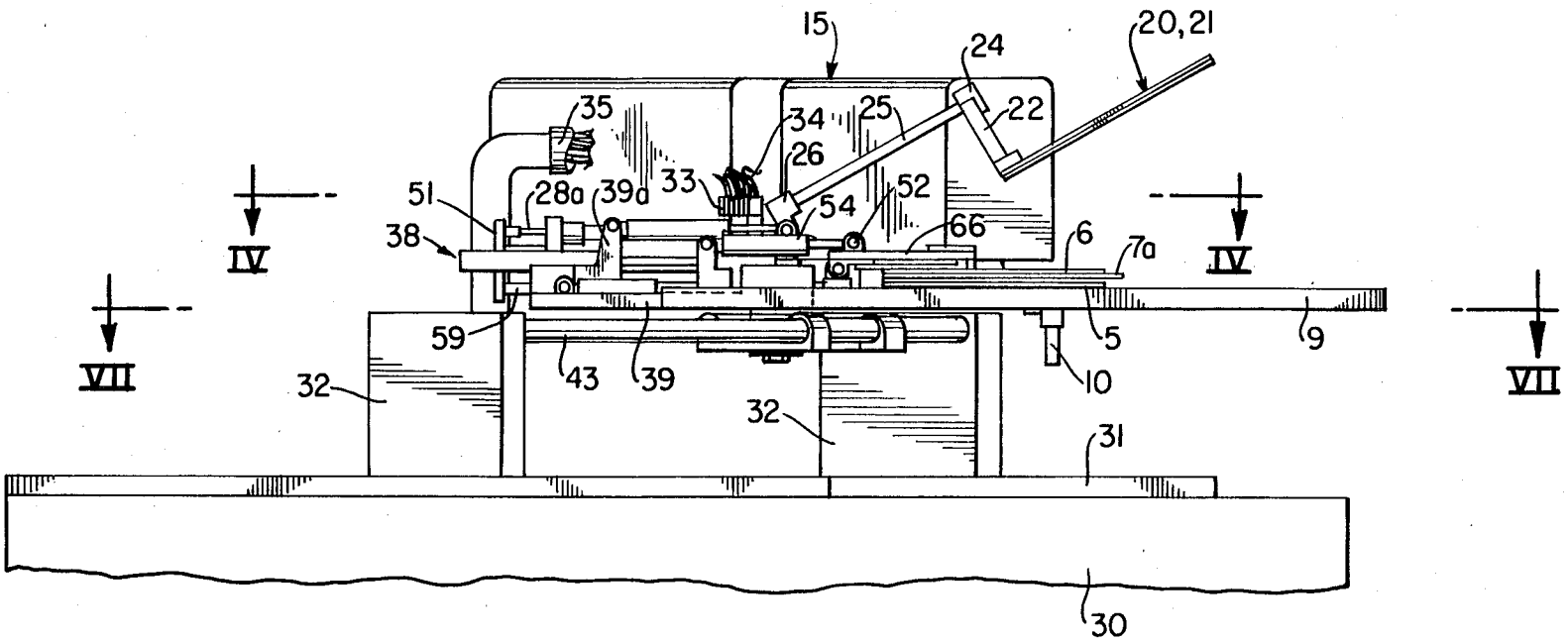

FIGS. 1 and 2 illustrate overall views of such apparatus respectively in plan and in elevation. The frame 30 supports a lower table 31 and projecting therefrom vertical base members 32. The vertical base member 32 provides support for rails 42 and 43.

Figure 3:
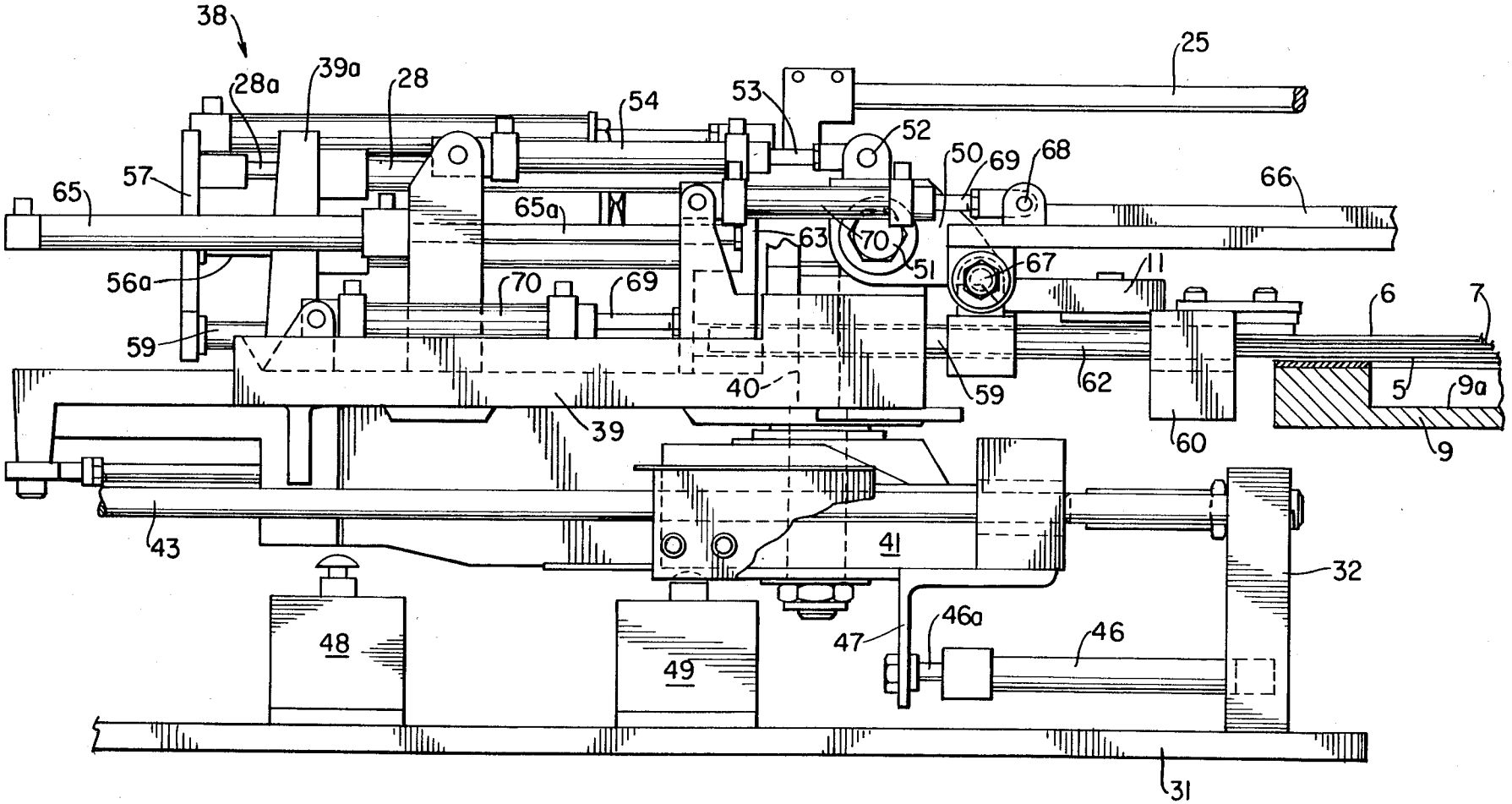
FIG. 3 is an enlarged side or elevational view of the apparatus of the present invention.
Figure 7:
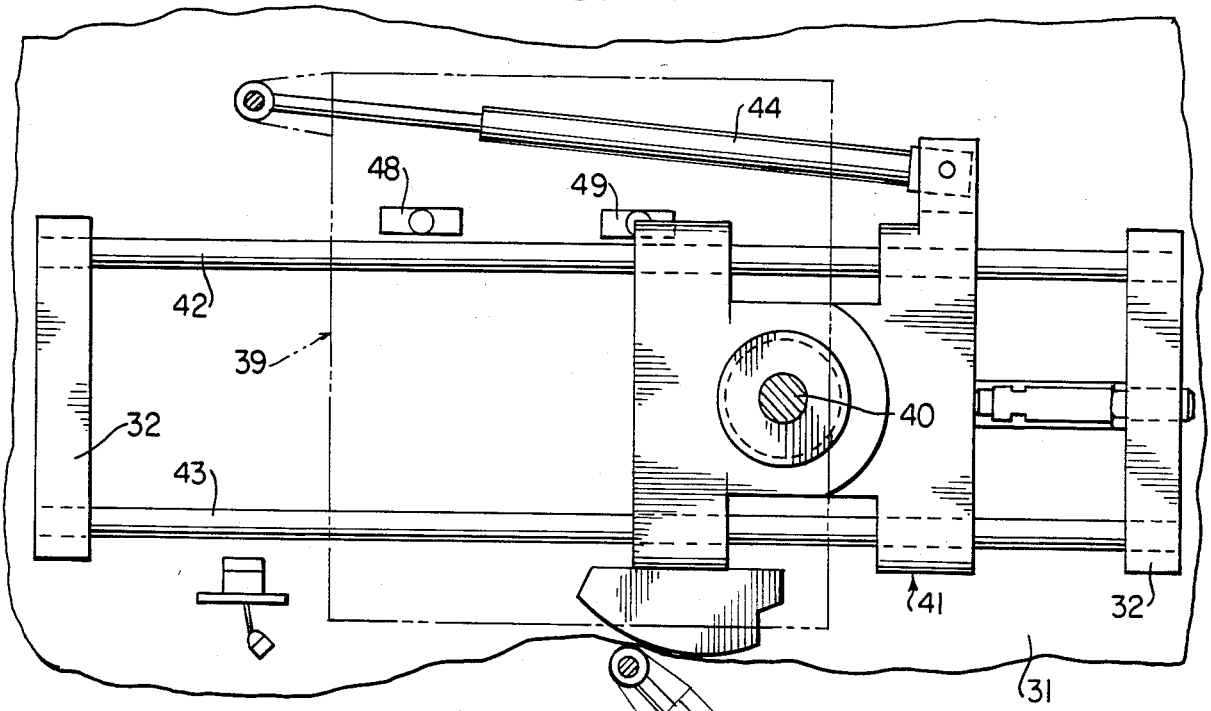
FIG. 7 is a plan view of the carrier support pivot for the apparatus with the carrier in the feed position.
Figure 8:
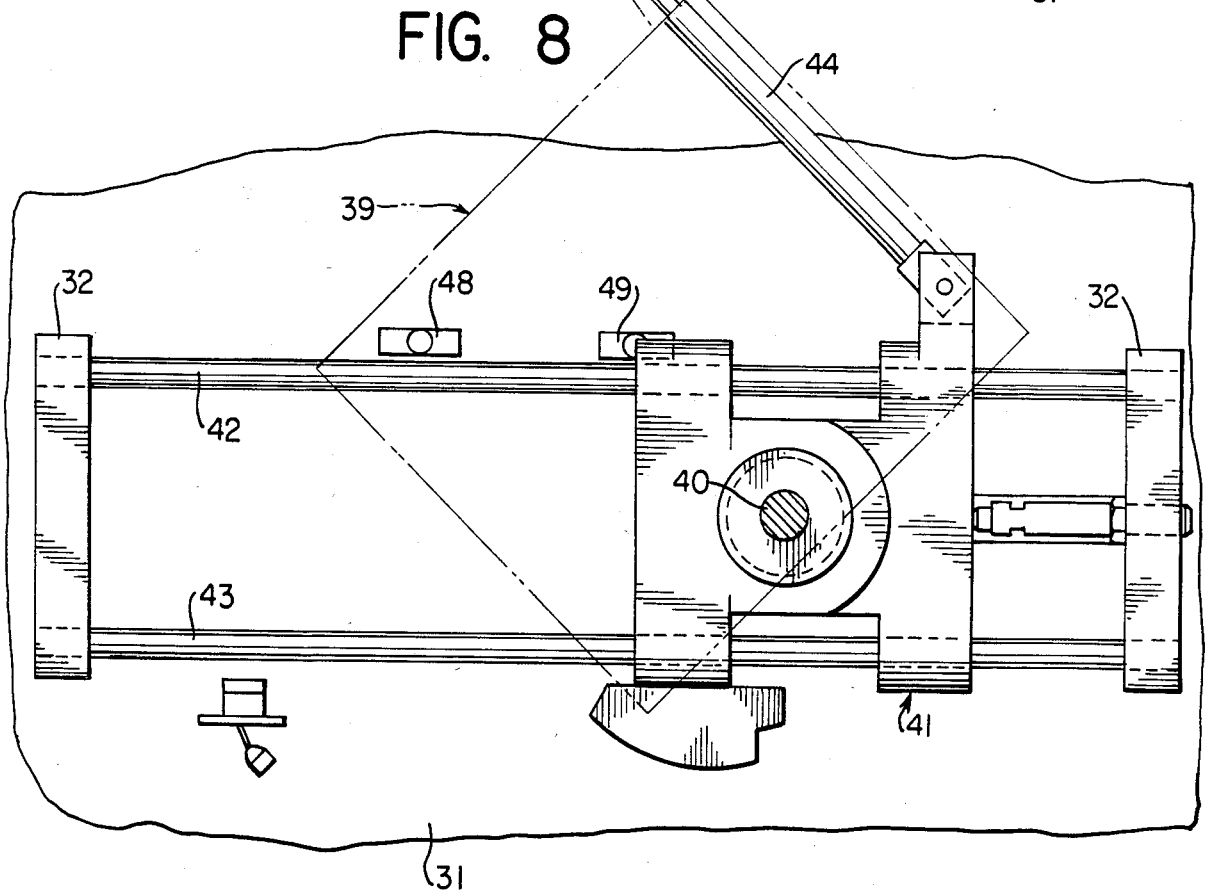
FIG. 8 is a plan view of the carrier support blade pivot for the apparatus with the carrier in the load position.
Figure 10:
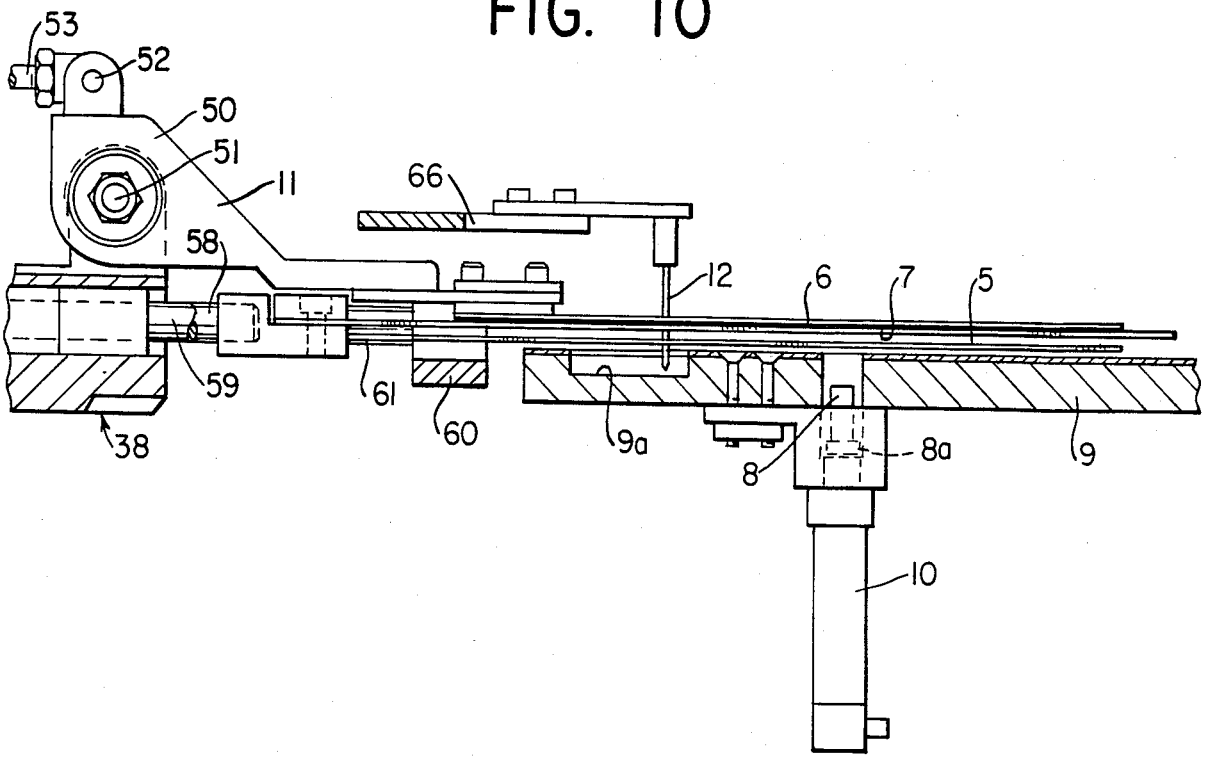
FIG. 10 is a side view of folder blade lifter details with folder blades at rest.

A folder carrier assembly 38 contains the means for supporting and controlling the movement of blades 5, 6 and 7 as well as the other devices described in connection with FIGS. 11–21. The carrier assembly includes pneumatic flow controls 33 which are connected to pneumatic flow lines 34 within harness 35. The means by which the various pneumatic actuators used to actuate portions of the apparatus are not part of the present invention and shall not be described. The carrier assembly 38 is mounted upon carrier support plate 39 (FIG. 3) which is pivotally interconnected through pivot shaft 40 to the lower slidable carrier support member 41 (FIGS. 7 and 8) which straddles two rails 42, 43. As best seen in FIGS. 7 and 8, the carrier support plate 39 may be rotated by means of actuator 44, and thus the carrier assembly 38 can be rotated between the placket loading position of FIG. 21 to the placket stitching position of FIG. 20. The lower carrier support member 41 is slidable upon rails 42, 43 by means of an actuator 46 whose reciprocal rod 46 is attached to lower carrier support member through bracket 47. Limit switches 48, 49 control actuation and deenergization of actuator 46.

Figure 4:
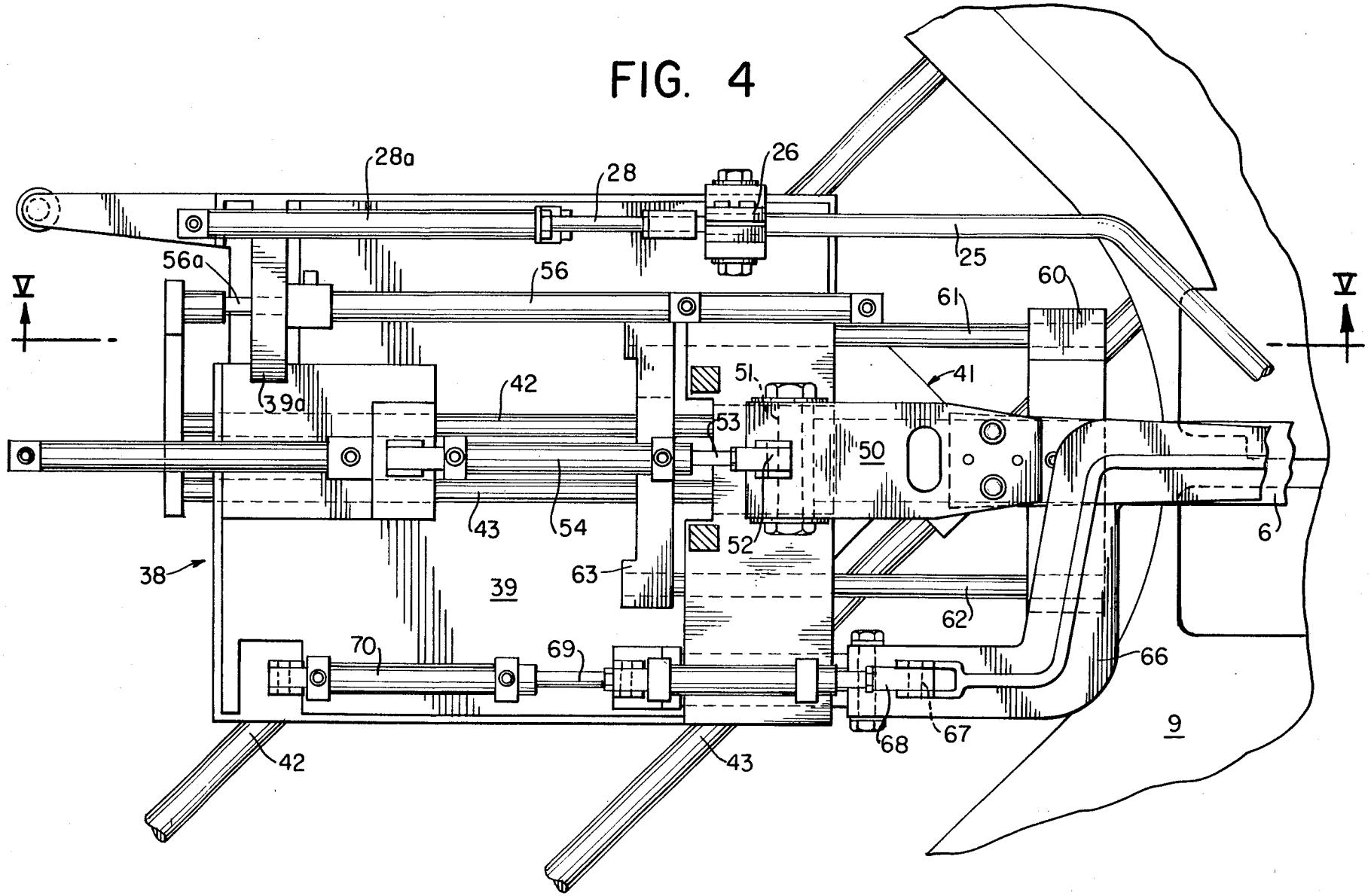
FIG. 4 is a view taken in the direction of arrows IV—IV of FIG. 2.

Referring to FIG. 4, the means for raising and lowering the upper blade 6 (FIGS. 11 et. seq.) shall now be described. The end of blade 6 toward carrier assembly 38 is attached to an arm 50 which will pivot about shaft 51 (connected to carrier support plate) to raise or lower blade 6 when bell-crank connection 52 (FIG. 9) is acted upon by rod 53 reciprocally movable by actuator 54.

Figure 9:
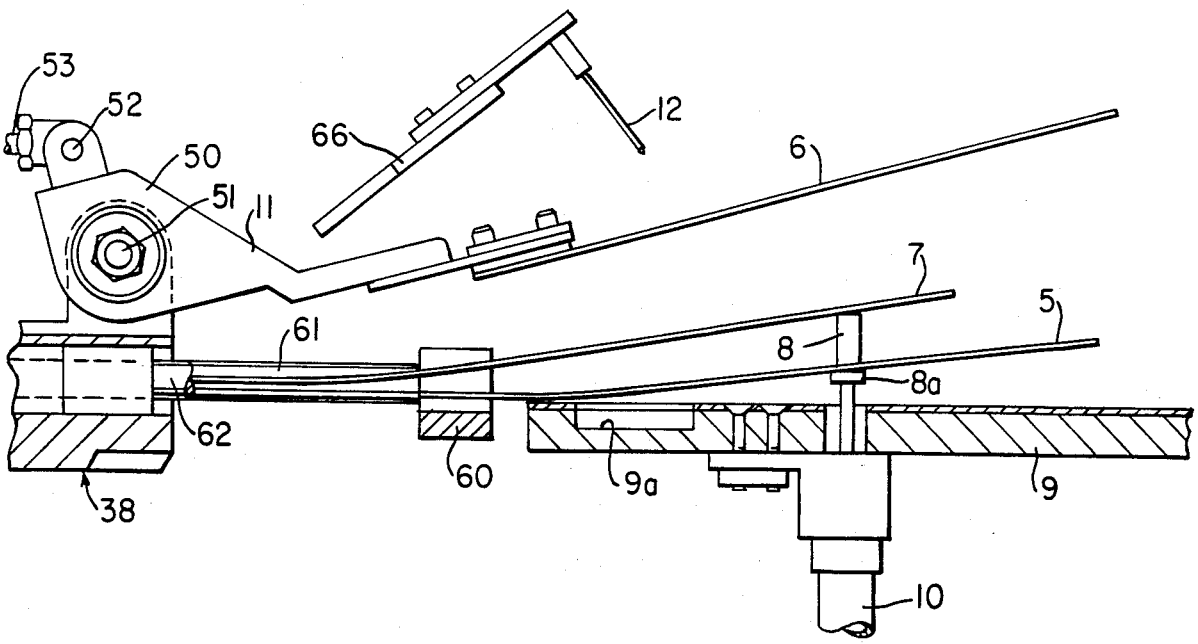
FIG. 9 is a side view of the folder blades lifted for loading.

Referring to FIGS. 4, 5 and 9, the center blade actuator 56 is mounted to carrier support plate extension 39*a*, and rod 56*a* reciprocally movable therefrom is attached to center blade bracket 57. The latter is attached to two rods 58, 59 which may extend blade 7 toward and away from the placket as previously described.

As best seen in FIG. 4, the lower blade 5 is attached to forward yoke 60 which is connected to rods 61, 62. At the rear, rods 61, 62 are connected to yoke 63 reciprocally movable by its connection with actuator 65 and rod 65*a*.

Referring to FIG. 4, the stretch pin 12 is connected to an arm 66 which is pivotable about 67 by means of the connection between bell-crank 68 and a series of rods 69 reciprocally movable by actuator 70.

Fabric hold-down fingers 20, 21 (FIGS. 5 and 19–21) are connected to supports 22, 23 and to outer carrier 24. Arm 24 is secured in inner carrier 26 which is pivotally mounted to support plate 39 at 27. Reciprocation of rod 28*a* of actuator 28 therefore will raise or lower fingers 20, 21.

It will be understood that sequence of the various steps of the method as initially described will take place by means of programmed sequential actuation of the various parts of the apparatus described in connection with the figures. The operator of the apparatus of the present invention will be able to initiate the sequence progressively. For example, during the initial step of loading the placket halves upon the lower and upper carrier blades 5, 6 carrier assembly 38 will be in its "loading" position. When the operator wishes to load the blades 5 & 6, the operator will cause actuation of pin 8 to spread the lower and intermediate blades while the upper blade is raised by its actuation. Once the initial loading of placket halves 4*a* and 4*b* has taken place, the operator will initiate withdrawl of pin 8 and lowering of upper blade 7 to complete the loading process. Actuation of stretch pin 12 and the subsequent steps will follow some of which will be under the control of the operator to initiate and some of which will be sequentially controlled by the programmer.

By means of the apparatus of the present invention, a high production capability has been provided uniformly to complete the finalization of plackets, that is, the finalization has been truly automated. The placket parts are uniformly positioned, straightened and held while being transported from the loading station to the sewing station until clamp/template 14 is brought into place to secure the placket area to be stitched. Only after clamp-/template 14 is securely positioned does withdrawl of the blades 5, 6 & 7 and stretch pin occur and upon such occurence the carrier assembly 38 will be returned to the loading position. It will be understood that the foregoing description has described the method of the invention and has been representative with respect to the specific embodiment. In order to fully understand the scope of the invention, reference should be made to the appended claims.

I claim:

1. The method of forming a finished placket with respect to a slitted opening in a piece of fabric comprising the steps of forming an open-ended tubular member and placing said member perpendicular to said slitted opening immediately adjacent to the closed end thereof, folding the respective sides of said opening toward and into the said member and attaching said sides to said tubular member, folding said tube at the closed end to form superimposed placket halves, placing blades within each said placket halves and a blade intermediate said placket halves, causing said placket halves to be stretched over said blades and causing said intermediate blade to extend fully between the placket halves at the closed end of said placket, sequentially withdrawing said blades from said placket halves, and stitching the respective superimposed packet halves to each other at the closed end of said placket.

2. Apparatus for forming a finished placket with respect to a slitted opening in a piece of fabric wherein the respective sides of said opening comprise overlapping placket halves in the form of tubular sections, each having a closed end and being connected to each other at the closed end of the slitted opening and each having an open end at the open end of the slitted opening, said placket halves being superimposed and in alignment with said slitted opening, the apparatus comprising a work table which receives said fabric, three superimposed blades, upper, intermediate and lower respectively, said placket halves being manually drawn over the upper and lower blades with the intermediate blade lying between said placket halves, means for securing the open ends of said placket halves adjacent their open ends in relation to the upper, lower and intermediate blades, means for causing said securing means to draw said placket halves fully over the upper and lower blades, means for extending the intermediate blade to straighten the area connecting the placket halves at the inner end of the slitted opening, means for clamping and transporting said fabric and the fabric halves to a sewing station, means for sequentially withdrawing the upper, lower and intermediate blades and the securing means from said placket halves at the sewing station, means for stitching the overlying inner ends of said placket halves together to form a placket.

3. The apparatus according to claim 2 which includes means for vertically moving each of said blades prior to insertion of said upper and lower blades into said placket halves and means for withdrawal of said vertical separating means to permit said blades to lie flat upon said work table, said placket securing means comprising a stretch pin and means for causing said stretch pin to pierce the placket halves adjacent to the open ends thereof.

4. Apparatus according to claim 3 which includes a carrier assembly including respective actuating means to effect movement of said blades, the stretch pin, and the fabric clamping means, said carrier assembly being movable linearly along guide rails towards and away from the sewing machine head and being movable rotatively about a vertical axis to effect movement of the blades, stretch pin and fabric clamping means between a loading station and the sewing machine head.

* * * * *